US008134422B2

(12) United States Patent
Yamamoto

(10) Patent No.: US 8,134,422 B2
(45) Date of Patent: Mar. 13, 2012

(54) NON-RECIPROCAL CIRCUIT DEVICE

(75) Inventor: Shinji Yamamoto, Tottori (JP)

(73) Assignee: Hitachi Metals, Ltd., Tokyo (JP)

( * ) Notice: Subject to any disclaimer, the term of this patent is extended or adjusted under 35 U.S.C. 154(b) by 335 days.

(21) Appl. No.: 12/596,327

(22) PCT Filed: Apr. 15, 2008

(86) PCT No.: PCT/JP2008/057362

§ 371 (c)(1),
(2), (4) Date: Oct. 16, 2009

(87) PCT Pub. No.: WO2008/133119

PCT Pub. Date: Nov. 6, 2008

(65) Prior Publication Data

US 2010/0117754 A1 May 13, 2010

(30) Foreign Application Priority Data

Apr. 17, 2007 (JP) ..... 2007-108377

(51) Int. Cl.
*H01P 1/387* (2006.01)

(52) U.S. Cl. ..... 333/1.1; 333/24.2

(58) Field of Classification Search ..... 333/1.1, 333/24.2

See application file for complete search history.

(56) References Cited

U.S. PATENT DOCUMENTS

| | | | |
|---|---|---|---|
| 4,749,965 | A | 6/1988 | Prevot et al. |
| 4,868,971 | A | 9/1989 | Prevot et al. |

FOREIGN PATENT DOCUMENTS

| | | | |
|---|---|---|---|
| JP | 62-247605 | A | 10/1987 |
| JP | 10-190315 | A | 7/1998 |
| JP | 2000-286613 | A | 10/2000 |
| JP | 2005-080087 | A | 3/2005 |

*Primary Examiner* — Stephen Jones

(74) *Attorney, Agent, or Firm* — Sughrue Mion, PLLC

(57) ABSTRACT

A non-reciprocal circuit device comprising a ground plate having pluralities of external projections, a resin member having a hole through which the ground plate is exposed, a garnet plate disposed in the hole of the resin member, a microstrip line member disposed on a main surface of the garnet plate, a partition member disposed on the microstrip line member, and a permanent magnet disposed on the partition member between a pair of metal cases in this order from bottom, at least part of the external projections of the ground plate extending through the hole of the resin member over an upper surface of the partition member, and being bent to enclose the garnet plate, the microstrip line member and the partition member.

7 Claims, 12 Drawing Sheets

NON-RECIPROCAL CIRCUIT DEVICE

CROSS REFERENCE TO RELATED APPLICATIONS

This application is a National Stage of International Application No. PCT/JP2008/057362 filed Apr. 15, 2008, claiming priority based on Japanese Patent Application No. 2007-108377, filed Apr. 17, 2007, the contents of all of which are incorporated herein by reference in their entirety.

FIELD OF THE INVENTION

The present invention relates to a non-reciprocal circuit device such as an isolator or a circulator used as microwave-band, high-frequency parts for automobile phones, cell phones, etc.

BACKGROUND OF THE INVENTION

In general, a non-reciprocal circuit device such as an isolator or a circulator has a function to pass a signal only in a transmitting direction, while blocking the transmission of a signal in an opposite direction. Such isolator and circulator have a distribution-constant type and a lumped-constant type. FIG. 16 shows the internal structure of a distribution-constant-type, non-reciprocal circuit device, and FIG. 17 shows its cross section. This non-reciprocal circuit device comprises a microstrip line member 35 having three lines radially extending from a circular center portion, which may be called a central conductor, a pair of garnet plates 30, 30 disposed on both sides of the circular center portion of the microstrip line member 35, and permanent magnets 20, 20 disposed on both sides of the garnet plates 30, 30 for applying a DC magnetic field thereto, between upper and lower metal cases 10*a*, 10*b*. The number of permanent magnets 20 may be one. The lines of the microstrip line member 35 are connected to terminals 150*a*-150*c* of connectors 120*a*-120*c* arranged on side surfaces of the metal case 10*b*.

FIG. 18 shows the appearance of a distribution-constant-type, non-reciprocal circuit device described in JP 2003-124711 A, and FIG. 19 shows its internal structure. This non-reciprocal circuit device 1 comprises an upper iron plate 13, a permanent magnet 20, a lower iron plate 15, a ground plate 16, two garnet ferrite plates 30, a microstrip line member 35 sandwiched by two ferrite plates 30, and a ground plate 16, in this order from above between a metal case 10 and an upper lid 12. The microstrip line member 35 is usually formed by a copper plate as thin as 0.1-0.25 mm, and comprises a resonance portion (substantially triangular center portion) resonating in a TM110 mode, three lines 35*a*-35*c* radially extending from the resonance portion, impedance converters each as long as $\lambda/4$ and disposed in each line 35*a*-35*c* for impedance matching, and input/output electrodes 36*a*-36*c* each disposed at a tip end of each line 35*a*-35*c*. The input/output electrodes 36*a*-36*c* project from the metal case 10 to be soldered to a circuit board.

When current is supplied to the microstrip line member 35, a high-frequency magnetic field is generated from the garnet plate 30. Because the permanent magnet 20 generates a rotating magnetic field in the garnet plate 30, the polarization plane of the high-frequency magnetic field input to any one of the lines 35*a*-35*c* rotates, giving an output only to a predetermined line.

Investigation has been conducted so far to miniaturize distribution-constant-type, non-reciprocal circuit devices, but their miniaturization has been difficult because the size of garnet plates is determined by the operating frequencies of the non-reciprocal circuit devices. Proposals also have been made to increase the performance of permanent magnets, and to use one permanent magnet, despite their limits.

In addition, the positional deviation of constituent parts lowers the electric characteristics of non-reciprocal circuit devices. A DC magnetic field applied from the permanent magnet 20 to the garnet plate 30 should be uniform, but the positional deviation of parts such as the garnet plate 30, the microstrip line member 35, the ground plate 40, the resin member 60, etc. provides a non-uniform magnetic field, making the impedance of input/output terminals 36*a*-36*c* different from a designed level, and thus failing to achieve the desired electric characteristics. The positional deviation of parts may occur not only in assembling, but also by impact during use, etc. Thus proposed is the bonding of input/output terminals 36*a*-36*c* to peripheral sides of the garnet plate 30. However, the bonding needs pluralities of steps, an adhesive may spread to a main surface of the garnet plate 30, and an adhesive may form parasitic capacitance between the input/output terminals and the ground plate 40.

OBJECT OF THE INVENTION

Accordingly, an object of the present invention is to provide a non-reciprocal circuit device that can easily be made thinner without deteriorating electric characteristics, and that does not suffer the positional deviation of members disposed between metal cases.

DISCLOSURE OF THE INVENTION

The non-reciprocal circuit device of the present invention comprises a ground plate having pluralities of external projections, a resin member having a hole through which the ground plate is exposed, a garnet plate disposed in the hole of the resin member, a microstrip line member disposed on a main surface of the garnet plate, a partition member disposed on the microstrip line member, and a permanent magnet disposed on the partition member, between a pair of metal cases in this order from bottom, at least part of the external projections of the ground plate extending through the hole of the resin member over an upper surface of the partition member, and being bent to enclose the garnet plate, the microstrip line member and the partition member.

It is preferable that a lower surface of the lower metal case is provided with terminal members, and that the microstrip line member is bent toward the lower surface to achieve connection with high-frequency terminals among the terminal members. Part of the projections of the ground plate which do not extend through the hole are preferably bent toward the lower surface to achieve connection with a ground terminal among the terminal members. With such a structure, positional deviation among parts can be prevented, and the deformation of the microstrip line member can be prevented even if an external force is applied thereto.

The microstrip line member is preferably bonded to the garnet plate with an adhesive resin film. The adhesive resin film preferably has adhesive layers on both surfaces, so that it is also bonded to the partition member. With such a structure, positional deviation among the parts is further prevented. The use of a polyimide film having an adhesive silicone layer as the adhesive resin film makes it possible to keep good adhesion even when exposed to heat of about 260° C. during assembling and soldering of the non-reciprocal circuit device.

The microstrip line member preferably comprises a center portion, strip electrodes extending from the center portion, and branched lines between the strip electrodes, the branched lines acting as microstrip lines. The branched lines preferably have low-impedance lines at positions reaching an outer edge of the garnet plate, the low-impedance lines and the ground plate constituting grounded capacitors.

BRIEF DESCRIPTION OF THE DRAWINGS

FIG. 6(*b*) is a bottom view showing a resin substrate used in the non-reciprocal circuit device according to one embodiment of the present invention.

FIG. 14(*b*) is a bottom view showing a terminal substrate used in the non-reciprocal circuit device according to one embodiment of the present invention.

DESCRIPTION OF THE PREFERRED EMBODIMENTS

[1] First Embodiment

Figure 1:
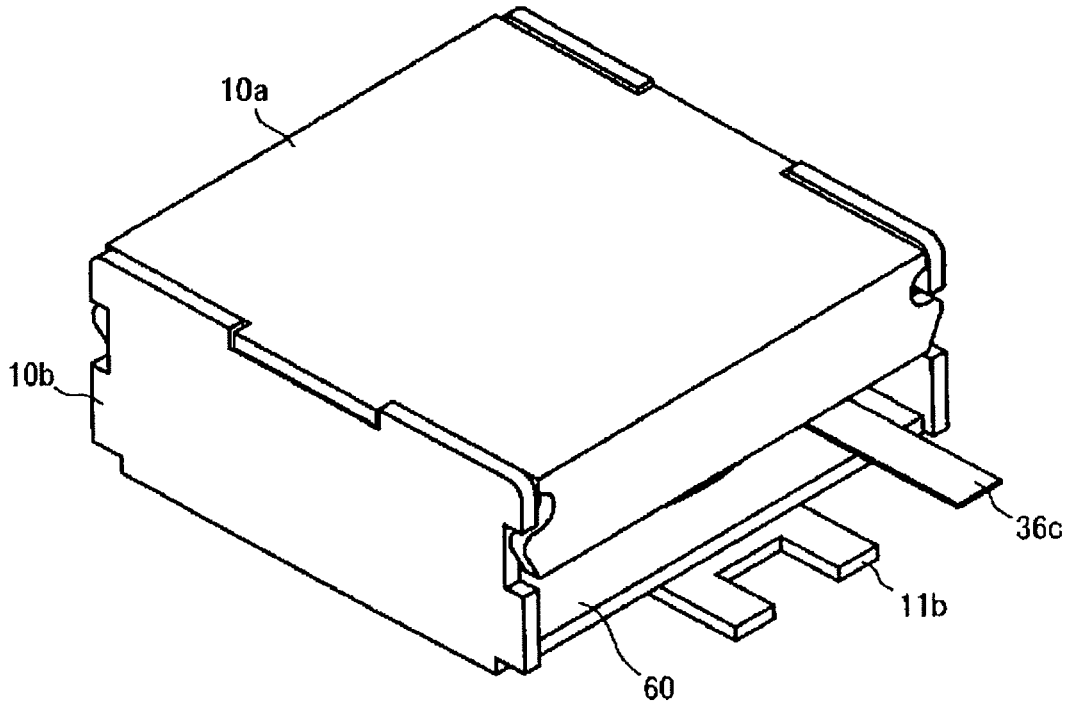
FIG. 1 is a perspective view showing the appearance of the non-reciprocal circuit device according to one embodiment of the present invention.
Figure 2:
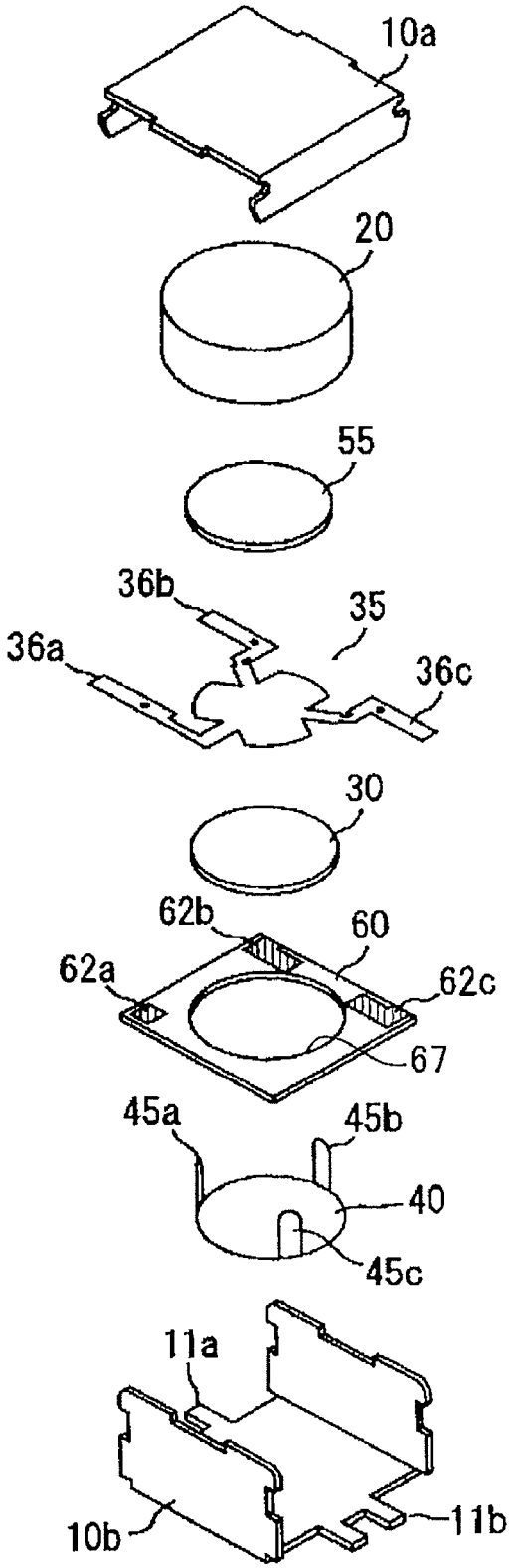
FIG. 2 is an exploded perspective view showing the internal structure of the non-reciprocal circuit device according to one embodiment of the present invention.
Figure 3:
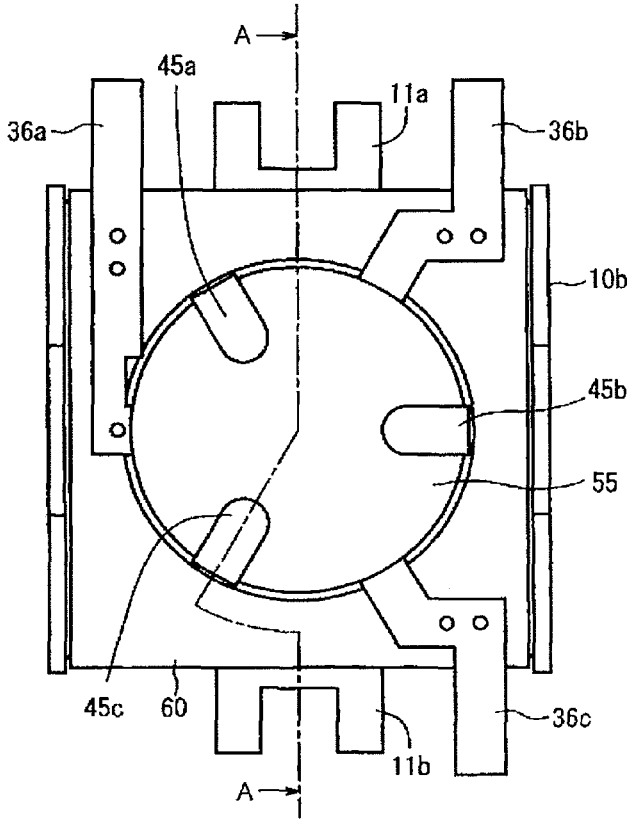
FIG. 3 is a plan view showing the internal structure of the non-reciprocal circuit device according to one embodiment of the present invention, with an upper metal case and a permanent magnet omitted.
Figure 4:
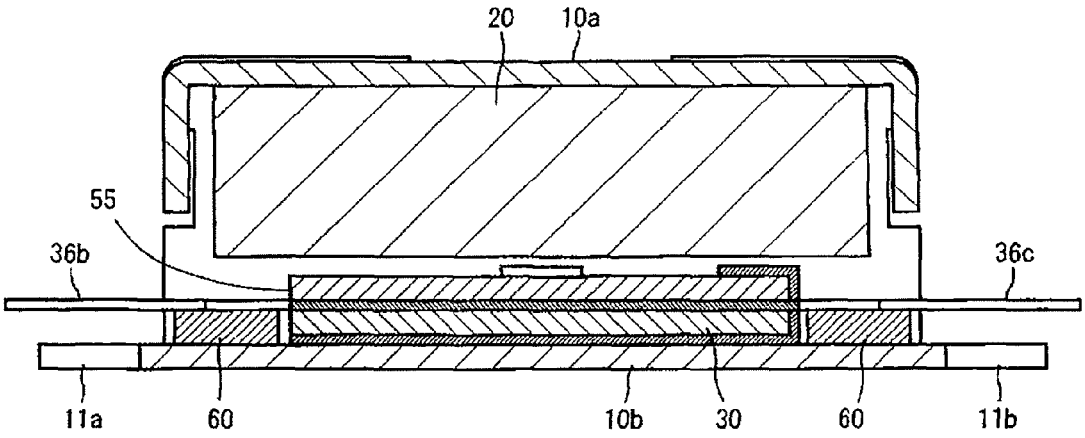
FIG. 4 is a cross-sectional view taken along the line A-A in FIG. 3.

FIGS. 1-7 show the non-reciprocal circuit device according to the first embodiment of the present invention as a circulator. This non-reciprocal circuit device comprises a lower metal case 10*b*, a ground plate 40 having pluralities of projections 45*a*-45*c* and disposed in the lower metal case 10*b*, a resin member 60 having a hole 67 substantially at center, through which the ground plate 40 is exposed, a garnet plate 30 disposed in the hole 67 of the resin member 60, a microstrip line member 35 disposed on the garnet plate 30, a permanent magnet 20 disposed on the microstrip line member 35 via a partition member 55, and an upper metal case 10*a* having projections received in recesses of the lower metal case 10*b* such that it integrally engages the lower metal case 10*b* with the above members contained, in this order from bottom. The microstrip line member 35 extends through a gap between the upper and lower metal cases 10*a*, 10*b* to be connected to an external circuit.

Figure 17:
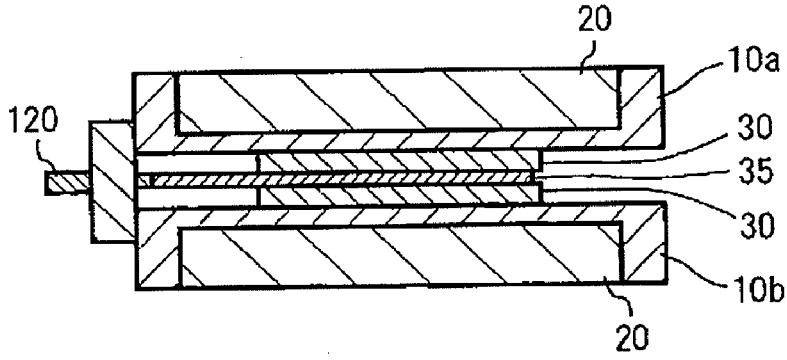
FIG. 17 is a cross-sectional view showing the internal structure of a conventional non-reciprocal circuit device.
Figure 18:
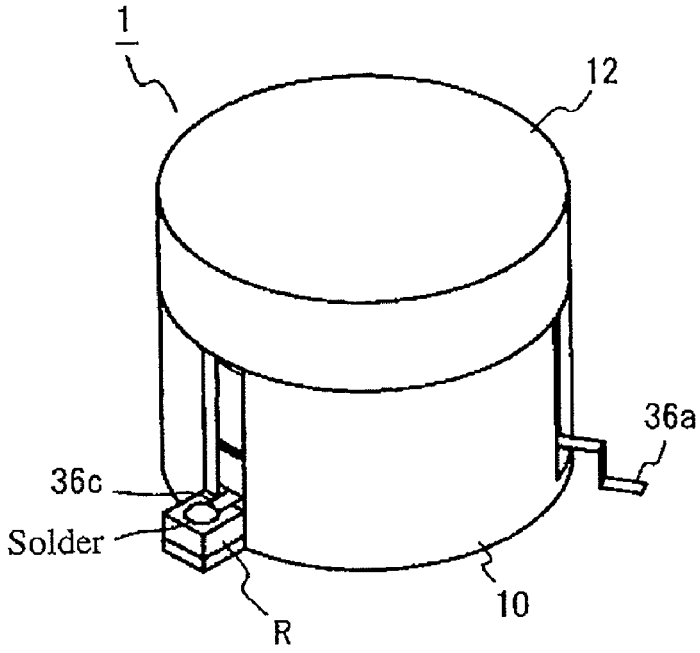
FIG. 18 is a perspective view showing the appearance of another conventional non-reciprocal circuit device.
Figure 19:
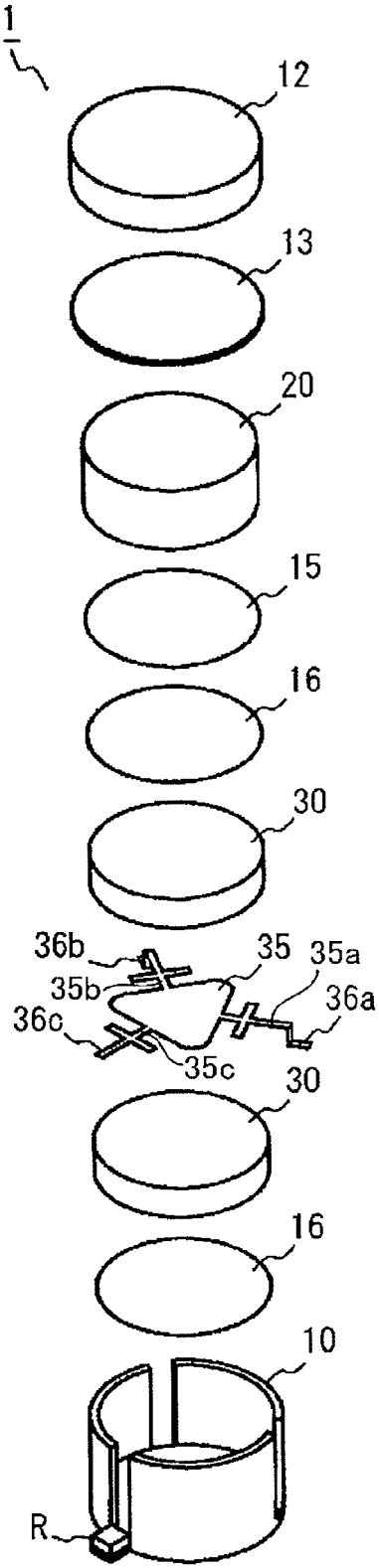
FIG. 19 is an exploded perspective view showing the internal structure of another conventional non-reciprocal circuit device.

Because the permanent magnet has 100 times as large dielectric loss as that of the garnet plate, the positioning of the microstrip line member close to the permanent magnet inevitably deteriorates electric characteristics. Also, when a metal magnet having small specific resistance, such as a samarium-cobalt magnet, a neodymium magnet, etc., is used as the permanent magnet, eddy current loss also deteriorates the electric characteristics. Accordingly, the microstrip line member and the permanent magnet should be arranged with a gap. Contrary to the conventional structure (tri-plate structure) having a microstrip line member sandwiched by two garnet plates as shown in FIG. 17, the present invention uses one garnet plate, with a partition member arranged between the microstrip line member and the permanent magnet. Because such structure increases magnetic energy in an air region not contributing to irreversibility, it has been considered that the bandwidth of a non-reciprocal circuit device becomes narrower. However, investigation by the inventors has revealed that the narrowing of the bandwidth can be prevented by a structure having a thinner garnet plate with reduced inductance and increased capacitance. Such structure reduces the height of the non-reciprocal circuit device.

The upper and lower metal cases 10*a*, 10*b* acting as a magnetic yoke are produced by punching a metal plate as thick as about 100-300 μm with excellent magnetic properties, which is made of SPCC, a 42Ni—Fe alloy, a 45Ni—Fe alloy, an Fe-Co alloy, etc., and bending it. The magnetic yoke preferably has the maximum permeability of 5000 or more and a saturation magnetic flux density of 1.4 Tesla or more. The upper and lower metal cases 10*a*, 10*b* also acting as ground are coated with a conductive metal (silver, copper, gold or aluminum) having electric resistivity of 5.5 μΩ·cm or less, preferably 3.0 μΩ·cm or less, more preferably 1.8 μΩ·cm or less. The thickness of the conductive metal coating is 0.5-25 μm, preferably 0.5-10 μm, more preferably 1-8 μm. The conductive metal coating serves as a path for high-frequency current to the ground terminal, increasing the transmission efficiency of high-frequency signals, and suppressing interference with the outside to reduce loss. Silver among the conductive metal is advantageous in solderability, contact resistance and cost, but it is easily discolored by reactions with oxygen, moisture, etc. in air, resulting in reduced solderability and increased contact resistance. Accordingly, its surface is provided with a protective layer such as an organic chelate coating, etc.

Figure 6A:
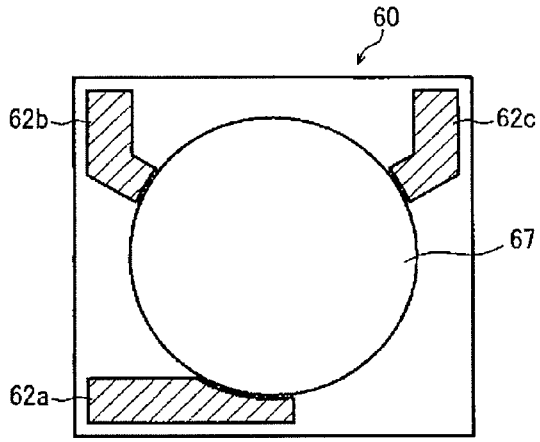
FIG. 6(*a*) is a plan view showing a resin substrate used in the non-reciprocal circuit device according to one embodiment of the present invention.
Figure 6B:
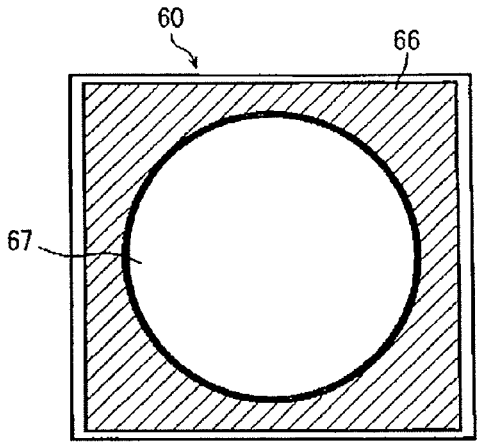
Figure 7:
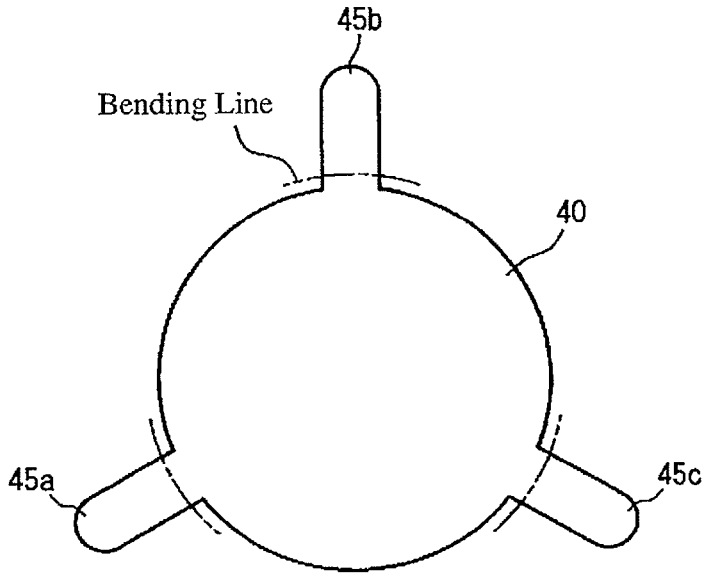
FIG. 7 is a plan view showing a ground plate used in the non-reciprocal circuit device according to one embodiment of the present invention.
Figure 8:
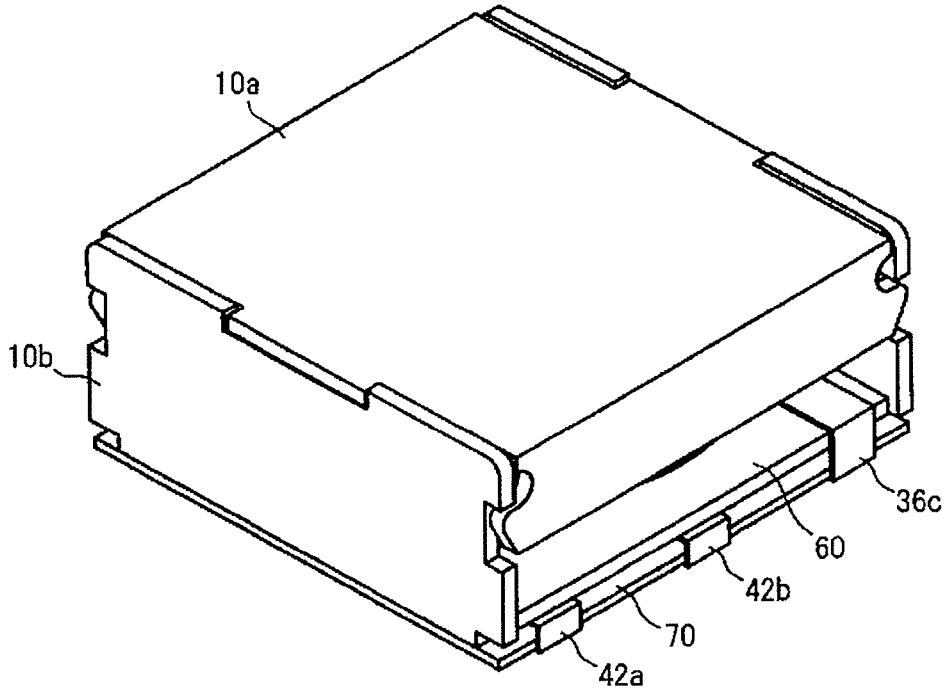
FIG. 8 is a perspective view showing the appearance of the non-reciprocal circuit device according to another embodiment of the present invention.
Figure 9:
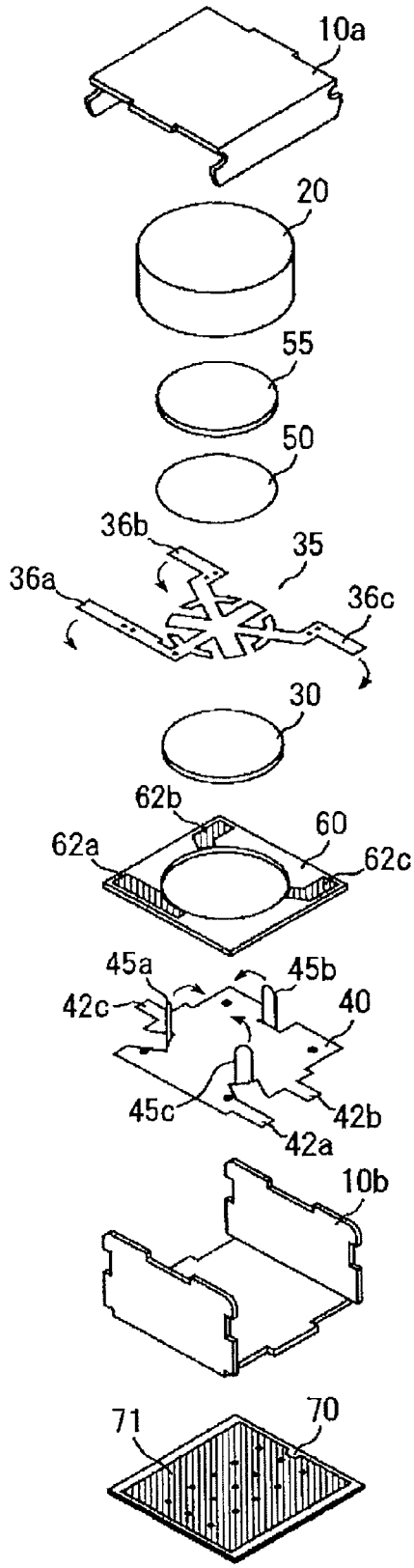
FIG. 9 is an exploded perspective view showing the internal structure of the non-reciprocal circuit device according to another embodiment of the present invention.
Figure 10:
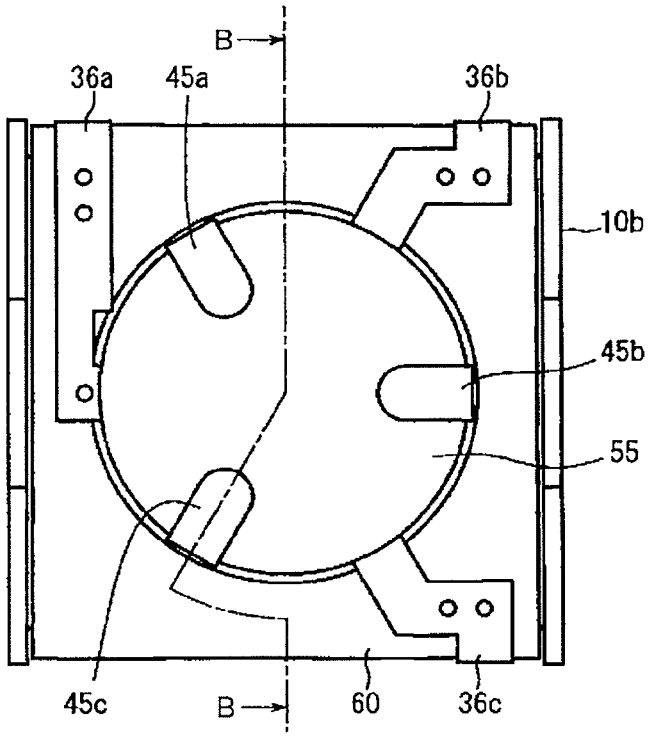
FIG. 10 is a plan view showing the internal structure of the non-reciprocal circuit device according to another embodiment of the present invention, with an upper metal case and a permanent magnet omitted.

The resin member 60 disposed on an inner bottom surface of the lower metal case 10*b* is a printed circuit board of a glass-fiber-reinforced epoxy resin, Teflon (registered trademark), etc. The resin member 60 has an upper surface provided with electrodes 62*a*-62*c* to which the microstrip line member 35 is soldered, as shown in FIG. 6(*a*), and a bottom surface entirely provided with a ground electrode 66 as shown in FIG. 6(*b*). Each electrode is plated with a solder. The ground electrode 66 is connected by solder to the lower metal case 10*b*. The impedance of the grounded capacitor constituted by the electrodes 62*a*-62*c* and the ground electrode 66 is adjusted by the areas of the electrodes 62*a*-62*c*. With the resin member 60 substantially as thick as the garnet plate 30, the microstrip line member 35 connected to the electrodes 62*a*-62*c* is on the same plane as the projections 45*a*-45*c* of the ground plate 40 bent on the upper surface of the garnet plate 30.

The ground plate 40 formed by a thin copper plate is disposed in the hole 67 of the resin member 60, and soldered. The projections 45*a*-45*c* of the ground plate 40 are bent upward to extend through the hole 67 over the upper surface of the resin member 60. The thickness of the ground plate 40 is preferably 0.05-0.2 mm, more preferably 0.08-0.15 mm. To prevent surface oxidation, the ground plate 40 is preferably provided with a protective plating of Ag, Au, etc. The protective plating preferably has electric resistivity of $1.0\times10^{-7}$ Ωm or less.

The garnet plate 30 is arranged in a region encircled by the projections 45*a*-45*c* of the ground plate 40 disposed in the hole 67 of the resin member 60. The garnet plate is preferably as thick as 0.15-0.5 mm. When the garnet plate 30 is as thin as less than 0.15 mm, it has too low strength, and does not provide necessary inductance, resulting in difference between input impedance and output impedance, large insertion loss, and a narrow passband. When it is as thick as more than 0.5 mm, a low-height non-reciprocal circuit device cannot be obtained.

Figure 5:
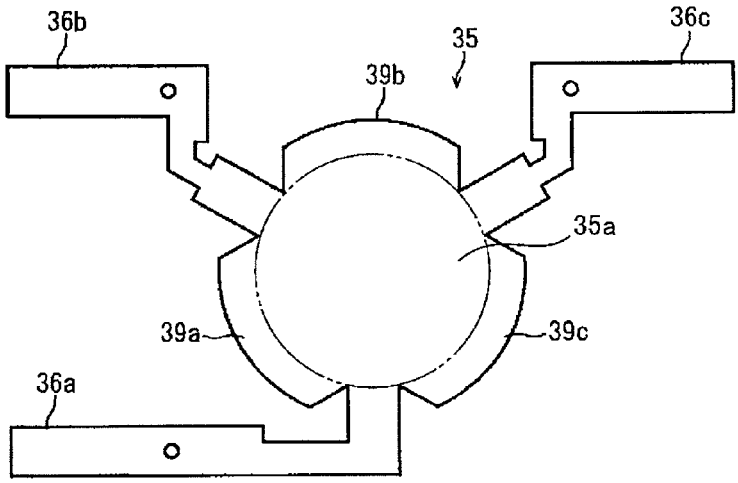
FIG. 5 is a plan view showing a microstrip line member used in the non-reciprocal circuit device according to one embodiment of the present invention.

The microstrip line member 35 is disposed on the garnet plate 30, such that the branched lines extend from between the projections 45*a*-45*c* of the ground plate 40. FIG. 5 shows a planar shape of the microstrip line member 35. The microstrip line member 35 is formed by etching a metal plate as thin as 30-250 μm. The microstrip line member 35 comprises a central connecting portion 35*a*, three strip electrodes 39*a*-39*c* extending from the connecting portion 35*a* to near a periphery of the garnet disc 30 with equal intervals, and three branched lines 36*a*-36*c* extending from between the strip electrodes 39*a*-39*c*. Each of the branched lines 36*a*-36*c* has one or more penetrating holes. The branched lines 36*a*-36*c* are bent along the side surface of the garnet disc 30, and connected to the stationary electrodes 62*a*-62*c* of the resin member 60 by heating a solder paste filled in the penetrating holes, with their end portions extending from between the upper and lower metal cases 10*a*, 10*b*. The extending end portions act as terminals connected to other circuit elements or a circuit board. The branched lines 36*a*-36*c* and the ground plate 40 constitute a grounded capacitor compensating the deviation of an operating frequency and the narrowing of the bandwidth.

The connecting portion 35*a* and the branched lines 36*a*-36*c* are arranged in rotation symmetry in a circulator, while a terminal resistor R is attached to one branched line in an isolator. If the terminal resistor R contains a large reactance component at an operating frequency, the deviation of impedance occurs, resulting in the deterioration of electric characteristics. To compensate this, the branched line connected to the terminal resistor R is preferably different in width from the other branched lines.

The partition member 55 is disposed in a region defined by the projections 45*a*-45*c* of the ground plate 40 such that it overlaps the strip electrodes 39*a*-39*c* of the microstrip line member 35. The partition member 55 is preferably made of heat-resistant resins, which are not softened at high temperatures in solder reflow, such as liquid crystal polymers, polyphenylene sulfide, polybutylene terephthalate, polyetheretherketone, epoxy resins, phenol resins, Teflon (registered trademark), etc. A conductor such as a copper foil, etc. may be attached to part of the partition member 55, such that it is connected to the projections 45*a*-45*c* of the ground plate 40. The thickness of the partition member 55 determining a gap between the microstrip line member 35 and the permanent magnet 20 is preferably 1-2 times the thickness of the garnet plate 30. The ratio exceeding 2 times fails to reduce the height of the non-reciprocal circuit device, and makes it likely that a DC magnetic field applied from the permanent magnet 20 to the garnet plate 30 has uneven distribution.

The lower metal case 10*b*, the ground plate 40, the resin member 60, the garnet plate 30, the microstrip line member 35 and the partition member 55 are arranged on an assembling jig, and a solder paste is applied to portions to be connected. Thereafter, the projections 45*a*-45*c* of the ground plate 40 are bent to achieve contact with the upper surface of the partition member 55. Passing through a reflow furnace, necessary soldering is conducted, and the microstrip line member 35 is fixed to the garnet plate 30.

The bonding of an adhesive resin film (for instance, a polyimide film having an adhesive silicone layer with excellent heat resistance) to the microstrip line member 35 makes it possible to surely prevent the positional deviation of parts. The resin film may have an adhesive layer on one or both sides. In the case of a double-coated adhesive film, both of the microstrip line member 35 and the partition member 55 are fixed simultaneously. Because an adhesive resin film can be handled easily, unevenness in assembling due to the difference of operators' techniques can be reduced. The adhesive silicone can keep adhesion even when exposed to about 260° C. during the assembling and soldering of the non-reciprocal circuit device.

The upper metal case 10*a* to which a permanent magnet 20 is bonded is disposed on the partition member 55, and projections of the upper metal case 10*a* on side walls are inserted into recesses of the lower metal case 10*b* on side walls, thereby obtaining a non-reciprocal circuit device having the appearance shown in FIG. 1.

EXAMPLE 1

The non-reciprocal circuit device having the structure shown in FIGS. 1-7 was produced as follows. Upper and lower metal cases 10*a*, 10*b* were punched out of a 0.5-mm-thick SPCC plate. A 5-μm-thick Cu plating layer, a 5-μm-thick Ni plating layer and a 0.05-μm-thick Au plating layer were formed on the lower metal case 10*a* in this order.

Disposed on an inner bottom surface of the lower metal case 10*b* were a 0.6-mm-thick resin member 60 made of a liquid crystal polymer, whose hole 67 received a ground plate 40. Placed on the ground plate 40 in the hole 67 was a garnet disc 30 having a diameter of 10 mm and a thickness of 0.5 mm, which was made of garnet ferrite having a dielectric constant $\epsilon r$ of 11, saturation magnetization 4 πMs of 115 mT, and dielectric loss tan $\delta\epsilon$ of $2\times10^{-4}$.

A microstrip line member 35 formed from a metal plate as thin as 100 μm by etching was placed on the garnet disc 30, and a partition member 55 formed by a 0.5-mm-thick silicone resin was placed on the microstrip line member 35. A permanent magnet 20 arranged on the partition member 55 was a La—Co-substituted ferrite magnet (YBM-9BE available from Hitachi Metals, Ltd., having a residual magnetic flux density Br of 430-450 mT, and coercivity iHc of 382-414 kA/m) having a diameter of 13 mm and a thickness of 6.0 mm. The distance between the microstrip line member 35 and the permanent magnet 20 was adjacent to 0.5 mm by the partition member 55.

A upper metal case 10*a* placed on the permanent magnet 20 was fit to the lower metal case 10*b*, to obtain a non-reciprocal circuit device having an outer size (excluding projections 11*a*, 11*b*) of 15 mm×15 mm×6.5 mm. This non-reciprocal circuit device was smaller than conventional ones by about 0.5 mm in height. The evaluation of electric characteristics using a network analyzer revealed that this non-reciprocal circuit device had insertion loss of 0.25 dB, return loss of 25 dB, and isolation of 30 dB at 2.5 GHz, comparable to conventional ones.

[2] Second Embodiment

FIGS. 8-15 show the non-reciprocal circuit device according to the second embodiment. This non-reciprocal circuit device differs from the non-reciprocal circuit device in the first embodiment in the shape of a microstrip line member 35, and in that a terminal member 70 made by a printed circuit board was disposed under the lower metal case 10*b*, and soldered to projections 42*a*-42*c* of the ground plate 40 and branched lines 36*a*-36*c* of the microstrip line member 35. Accordingly, explanation will be omitted on the same portions of the non-reciprocal circuit device as in the first embodiment.

Figure 12:
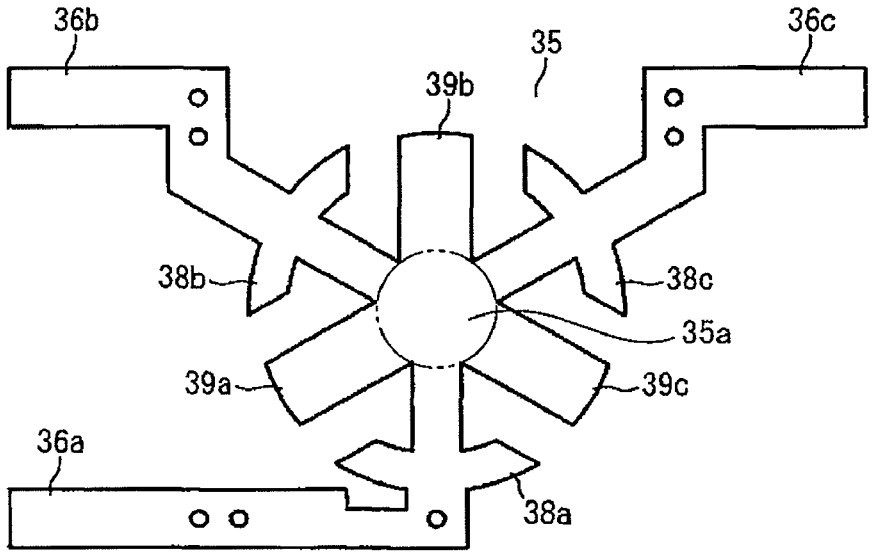
FIG. 12 is a plan view showing a microstrip line member used in the non-reciprocal circuit device according to another embodiment of the present invention.

As shown in FIG. 12, the microstrip line member 35 comprises a center portion (connecting portion) 35*a*, three strip electrodes 39*a*-39*c* extending from the connecting portion 35*a* to near the peripheral edge of the garnet disc 30 with equal intervals, and three branched lines 36*a*-36*c* extending from between the strip electrodes 39*a*-39*c*. Each of the branched lines 36*a*-36*c* is provided with a low-impedance line 38*a*-38*c* acting as a matching circuit, in a portion reaching the peripheral edge of the garnet disc 30.

Even when the area of the connecting portion 35*a* is extremely smaller than that of the garnet disc 30 to secure that the branched lines 36*a*-36*c* are as long as λ/4, the low-impedance lines 38*a*-38*c* can compensate the deviation of an operating frequency and the narrowing of bandwidth.

The adhesive resin film 50 is bonded to the upper surface of the microstrip line member 35. The adhesive resin film 50 is preferably larger than the connecting portion 35*a* of the microstrip line member 35, and equal to or smaller than the garnet plate 30.

Figure 13:
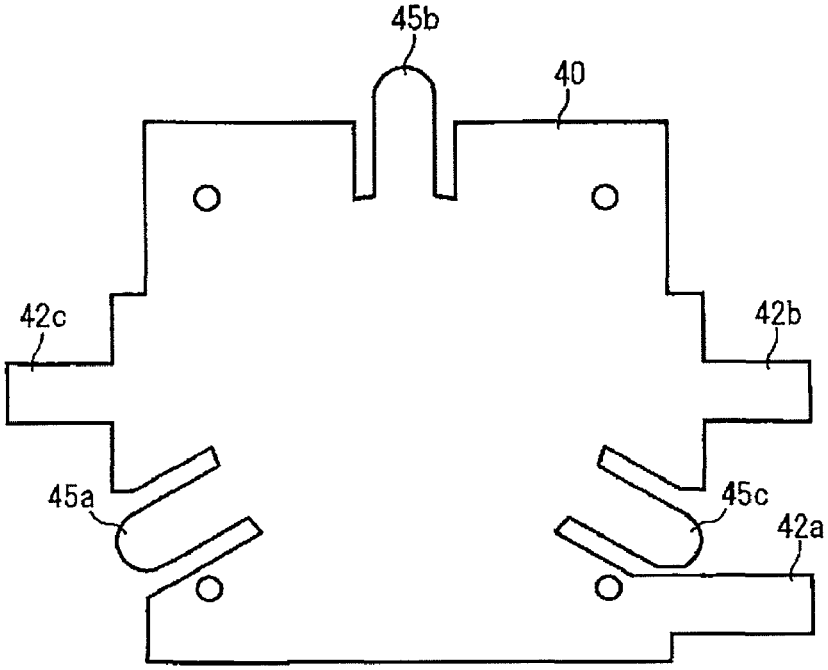
FIG. 13 is a plan view showing a ground plate used in the non-reciprocal circuit device according to one embodiment of the present invention.

As shown in FIG. 13, the ground plate 40 has six projections 42*a*-42*c*, 45*a*-45*c*. The projections 42*a*-42*c* are bent upward. Holes in corners of the ground plate 40 are used as markers showing connecting positions to the lower metal case 10*b*, to which a solder paste is applied.

Figure 14A:
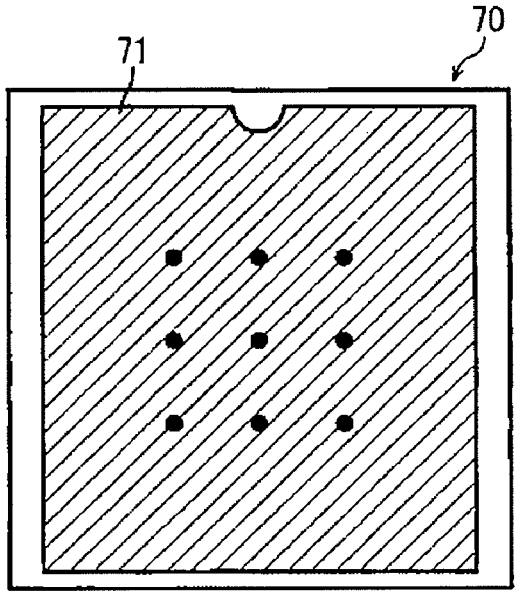
FIG. 14(*a*) is a plan view showing a terminal substrate used in the non-reciprocal circuit device according to one embodiment of the present invention.
Figure 14B:
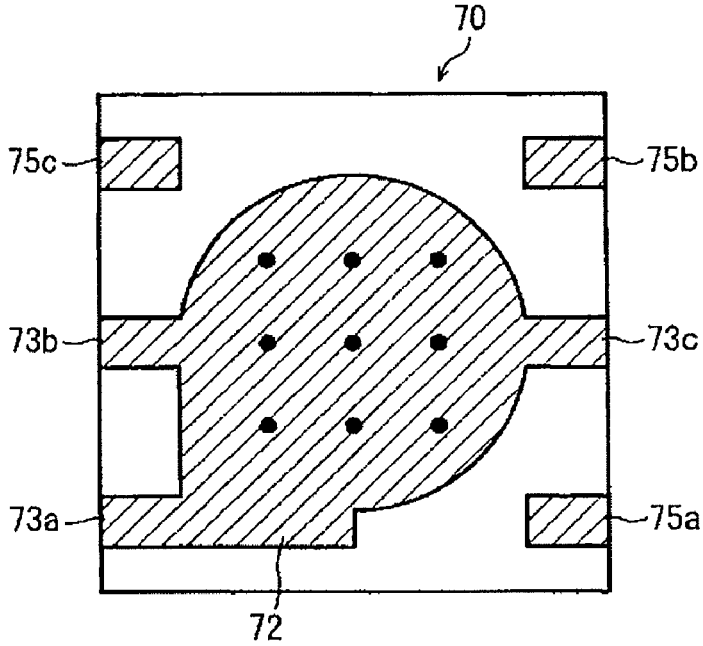

The terminal member 70 is formed by a printed circuit board, etc. of a glass-fiber-reinforced epoxy resin, Teflon (registered trademark), etc. As shown in FIG. 14(*a*), the entire upper surface of the terminal member 70 is provided with a ground electrode 71 connected to the lower metal case 10*b* by soldering. As shown in FIG. 14(*b*), the bottom surface of the terminal member 70 is provided with a ground electrode 72 in a center portion, and ground terminals 73*a*-73*c* connected to the ground electrode 72 and input/output electrodes 75*a*-75*c* in peripheral portions. The ground electrodes 71, 72 on the upper and lower surfaces are connected via through-holes (indicated by black circles in the figure). Each electrode is plated with solder.

Figure 11:
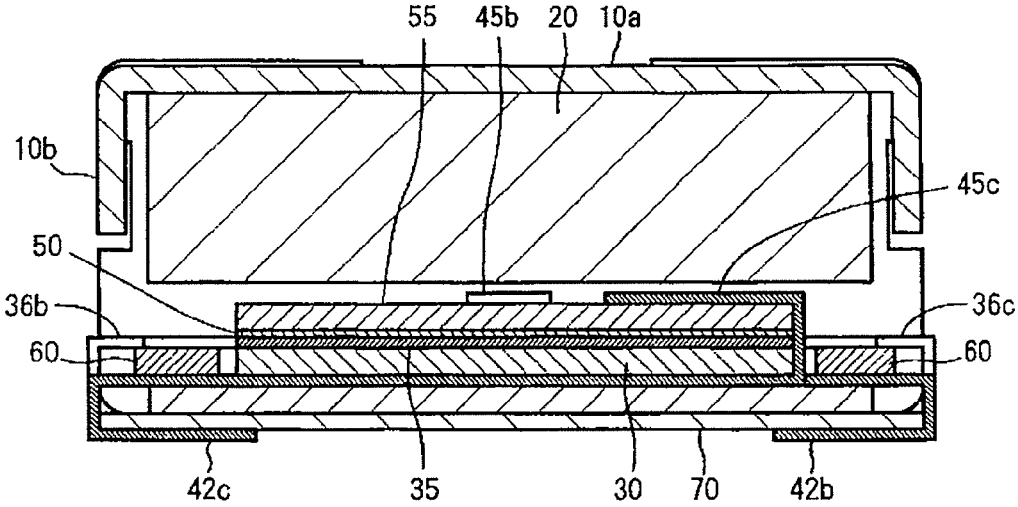
FIG. 11 is a cross-sectional view taken along the line B-B in FIG. 10.
Figure 15:
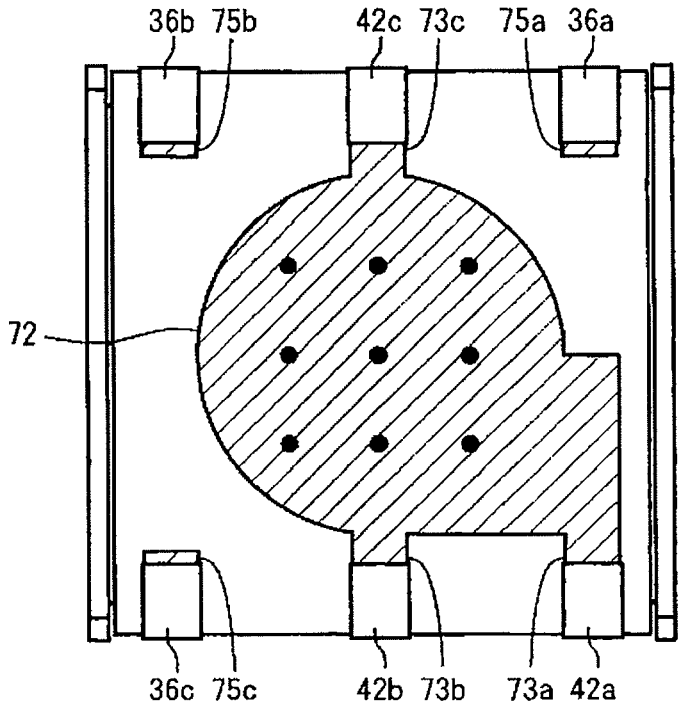
FIG. 15 is a bottom view showing the non-reciprocal circuit device according to another embodiment of the present invention.
Figure 16:
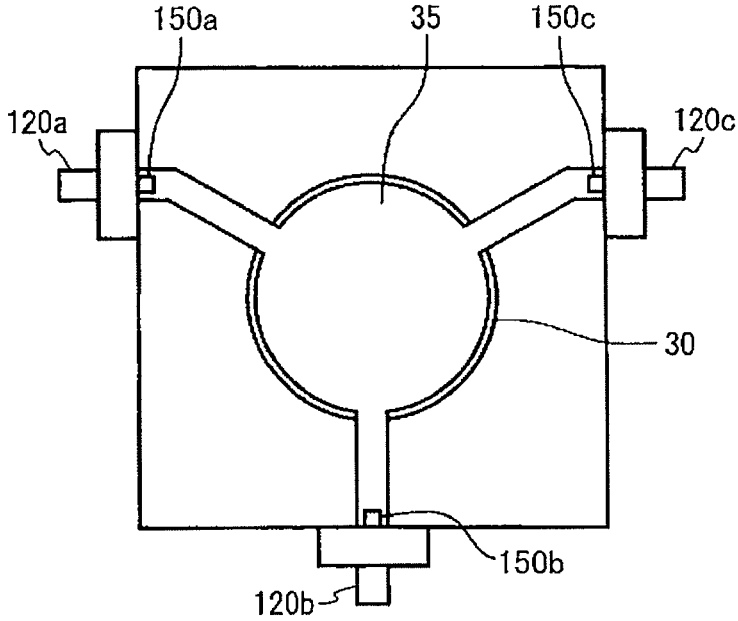
FIG. 16 is a plan view showing the internal structure of a conventional non-reciprocal circuit device.

After arranging parts in the same manner as in the first embodiment except that the terminal member 70 is disposed under the lower metal case 10*b*, applying a solder paste to portions to be connected, and bending the projections 45*a*-45*c* of the ground plate 40 to have contact with the upper surface of the partition member 55, the non-reciprocal circuit device is caused to pass through a reflow furnace, not only to conduct necessary soldering, but also to fix the microstrip line member 35 to the garnet plate 30. After reflow, the projections 42*a*-42*c* of the ground plate 40 are bent downward along the lower metal case 10*b* and the terminal member 70 as shown in FIG. 11, and connected to the ground terminals 73*a*-73*c* of the terminal member 70 as shown in FIG. 15. The branched lines 36*a*-36*c* of the microstrip line member 35 are also bent downward to enclose the resin member 60, the lower metal case 10*b* and the terminal member 70, and connected to the high-frequency terminals 75*a*-75*c* of the terminal member 70 as shown in FIG. 15.

When the projections 45*a*-45*c* and the branched lines 36*a*-36*c* are locally heated by a laser, a solder iron, etc., a plating on the electrodes of the terminal member 70 is melted, so that the projections 45*a*-45*c* and the branched lines 36*a*-36*c* are connected to the electrodes of the terminal member 70.

Because the projections 45*a*-45*c* of the ground plate 40 and the branched lines 36*a*-36*c* of the microstrip line member 35 are bent after reflow, sure soldering can be conducted without causing the positional deviation of these members. As a result, parts disposed between the metal cases are firmly held by the ground plate 40 and the microstrip line member 35, suffering no positional deviation by an external force after assembling, and no deterioration of characteristics.

Although the present invention has been explained in detail referring to the attached drawings, it is not restricted thereto, and various modifications may be added within the scope of the technical idea of the present invention. For instance, means for connecting parts may be brazing, conductive adhesives, spot-welding, etc., in addition to soldering. Although assembling is conducted successively from the ground plate 40 to the partition member 55, these parts may be assembled in advance to provide an integral assembly, which is received in the hole 67 of the resin member 60.

EFFECT OF THE INVENTION

With a structure using one garnet plate, having a ground plate, a garnet plate and a microstrip line member disposed in a hole of a resin member, and having the garnet plate and the microstrip line member enclosed by the ground plate and a partition member, the non-reciprocal circuit device of the present invention can be made thinner easily while preventing the positional deviation of parts, and without narrowing an operating bandwidth and deteriorating electric characteristics.

What is claimed is:

1. A non-reciprocal circuit device comprising a ground plate having pluralities of external projections, a resin member having a hole through which said ground plate is exposed, a garnet plate disposed in the hole of said resin member, a microstrip line member disposed on a main surface of said garnet plate, a partition member disposed on said microstrip line member, and a permanent magnet disposed on said partition member, between a pair of metal cases in this order from bottom, at least part of said external projections of said ground plate extending through the hole of said resin member over an upper surface of said partition member, and being bent to enclose said garnet plate, said microstrip line member and said partition member.

2. The non-reciprocal circuit device according to claim 1, wherein said microstrip line member comprises a center portion, strip electrodes extending from said center portion, and branched lines between said strip electrodes, said branched lines acting as microstrip lines.

3. The non-reciprocal circuit device according to claim 1, wherein said branched lines have low-impedance lines at positions reaching an outer edge of said garnet plate, said low-impedance lines and said ground plate constituting grounded capacitors.

4. The non-reciprocal circuit device according to claim 1, wherein a lower surface of said lower metal case is provided with terminal members, and said microstrip line member is bent toward the lower surface to achieve connection with high-frequency terminals among said terminal members.

5. The non-reciprocal circuit device according to claim 4, wherein part of the projections of said ground plate which do not extend through said hole are bent toward the lower surface to achieve connection with a ground terminal among said terminal members.

6. The non-reciprocal circuit device according to claim 1, wherein said microstrip line member is bonded to said garnet plate with an adhesive resin film.

7. The non-reciprocal circuit device according to claim 6, wherein said adhesive resin film has adhesive layers on both surfaces, so that it is also bonded to said partition member.

* * * * *